United States Patent [19]

Ettischer et al.

[11] Patent Number: 5,029,841

[45] Date of Patent: Jul. 9, 1991

[54] SUPPLY MAGAZINE FOR STACKED SHEETS

[75] Inventors: Helmut Ettischer, Ostfildern; Anton Oswald, Esslingen, both of Fed. Rep. of Germany

[73] Assignee: Eastman Kodak Company, Rochester, N.Y.

[21] Appl. No.: 486,981

[22] Filed: Mar. 1, 1990

[30] Foreign Application Priority Data

Mar. 4, 1989 [DE] Fed. Rep. of Germany ..... 3906984

[51] Int. Cl.[5] ..... B65H 1/04

[52] U.S. Cl. ..... 271/171; 271/223

[58] Field of Search ..... 271/171, 223, 224

[56] References Cited

U.S. PATENT DOCUMENTS 4,773,638 9/1988 Koutoudis ..... 271/171 X 4,943,043 7/1990 Huggins ..... 271/224 X

FOREIGN PATENT DOCUMENTS 84731 6/1980 Japan ..... 271/171

*Primary Examiner*—Richard A. Schacher

*Attorney, Agent, or Firm*—Lawrence P. Kessler

[57] ABSTRACT

A supply magazine (1) for stacked sheets (5) comprises on its bottom surface a slideway (13, 14) adapted for cooperation with a limiting member (11, 12) allowing a continuous size adjustment. The slideway (13, 14) is moreover provided at selected points with abutments (37); and a limiting member (11, 12) which has complementary counterabutments can be arrested by positive engagement with the abutments respectively against shifting movement on the slideway (13, 14) in positions corresponding to given sheet sizes.

11 Claims, 6 Drawing Sheets

5
3
12
35
31
29
3
45
17
21
20
19
15
13
19
20
17
27
45
21
3

SUPPLY MAGAZINE FOR STACKED SHEETS

BACKGROUND OF THE INVENTION

The invention relates to a supply magazine for stacked sheets, such supply magazine including a slideway provided on its bottom sheet-supporting surface serving to guide a limiting member which is shiftable along the slideway in order to continuously adjust the size of the sheet-support surface, and a clamping surface provided on the slideway to cooperate with a clamping means arranged on the limiting member in order to secure the limiting member by frictional contact in selected positions against shifting along the slideway.

Supply magazines of this generic type are known. A magazine of this type which is intended for use as a paper supply magazine for an electrophotographic copier is shown, for example, in U.S. Pat. No. 4,343,461 issued Aug. 10, 1982 in the name of Kiyoshi et al). The design and the features of such known magazines are specially adapted to a particular purpose and/or a specific apparatus in which they are to be used. That is, these magazines are set to hold sheet stacks of a particular size or format. This, of course, limits usefulness of any one magazine in accommodating different size sheet stacks.

SUMMARY OF THE INVENTION

This invention is directed to a supply magazine in which abutments are arranged on a slideway, in that the abutments are distributed along the slideway in positions corresponding to the sizes of selected sheet formats and in that abutments are provided for engagement of a complementary counterabutment of a limiting member in order to secure the limiting member by positive engagement against movement along the slideway.

Since the slideway, according to the invention, is intended not only for cooperation with a continuously adjustable limiting member, but as a result of the presence of abutments arranged in selected positions, can also be used with a limiting member by which predefined formats can be set, one and the same magazine can be used for different purposes and together with different apparatus depending on which type of limiting members are used in it. If used, for example, with a copier which is intended for handling various sheet sizes, the supply magazine can have one or several continuously slidable limiting members which can be arrested by friction. If, on the other hand, the magazine is intended for use in an apparatus in which large volumes of sheets of identical sizes are to be handled, it can be provided with limiting members which are fixedly adjusted to the size concerned and arrested by positive engagement. In either case, one slideway each is preferably provided for an associated limiting member for size adjustment at the longitudinal and at the transverse sides of the sheet.

In the case of embodiments of the magazine according to this invention in which the abutments on the slideway or slideways are designed as recesses which are adapted to cooperate with a projection arranged on the associated limiting member, the projection being insertable into the selected recess from the upper side of the bottom surface, the arrangement may be such that the limiting members arrestable against sliding by positive engagement can be placed on the slideway from above. In the case of such embodiments, the limiting member placed on the slideway is preferably secured against disengagement by a plug connection having a snap lock and being effective between the slideway and the limiting member.

In the case of an advantageous embodiment of the magazine, the slideway has a holding surface adapted for positive guiding engagement with the limiting member which is arrestable by friction, such holding surface extending along the sliding area provided for size limitation and engageable by a guide element of the relevant limiting member. In order to allow simple guiding engagement with, and disengagement from the engageable holding surface of the slideway from the upper side thereof, the abutment surface comprises a recess of a size allowing the guide element to be passed at a point outside the sliding area.

In an embodiment of the magazine of that type where the guiding engagement between the guide element of the limiting member and the holding surface on the slideway can be interrupted if the limiting member is shifted along the slideway beyond the intended sliding area, until the guide element is aligned with the recess, provisions can be made in order to prevent the limiting member from being normally shifted beyond the intended sliding area.

For this propose, a locking mechanism can be provided which is operative between the slideway and the limiting member. This locking mechanism may be designed such that it is automatically activated when the guide element of the limiting member is passed through the recess and the limiting member is then shifted in order to move the guide element along the holding surface away from the area of the recess. For this purpose, a spring-loaded latch may be provided on the limiting member, such latch being received behind a locking element of the slideway when the guide element is moved away from the recess.

The holding surface of the slideway may also serve to secure the limiting member on the slideway and arrestable by positive engagement. Thus, the limiting member arrestable by positive engagement may comprise one or several holding elements which are adapted to snap behind the holding surface when the limiting member is placed on the slideway.

The supply magazine according to the invention is not only suitable for being selectively used with limiting members which are specially designed for continuous size adjustment in that they are slid and clamped in desired positions or which are specially designed such that they can be placed in a fixed position defined by positive engagement on the slideway, but it also allows limiting members to be used which can be both continously shifted and positioned by frictional engagement and positioned and held against sliding by positive engagement. In such a case, a limiting member is used which comprises both a selectively activatable clamping means and an abutment means serving as a counterabutment. The later then comprises a removable or movable counterabutment (e.g., a withdrawable counterabutment), i.e., a counterabutment which can be rendered inoperative if it is desired that the limiting member concerned be continuously slidable.

The invention, and its objects and advantages, will become more apparent in the detailed description of the preferred embodiments presented below.

BRIEF DESCRIPTION OF THE DRAWINGS

In the following, the invention will be explained in further detail with reference to the accompanying drawings in which.

DESCRIPTION OF THE PREFERRED EMBODIMENTS

Figure 1:
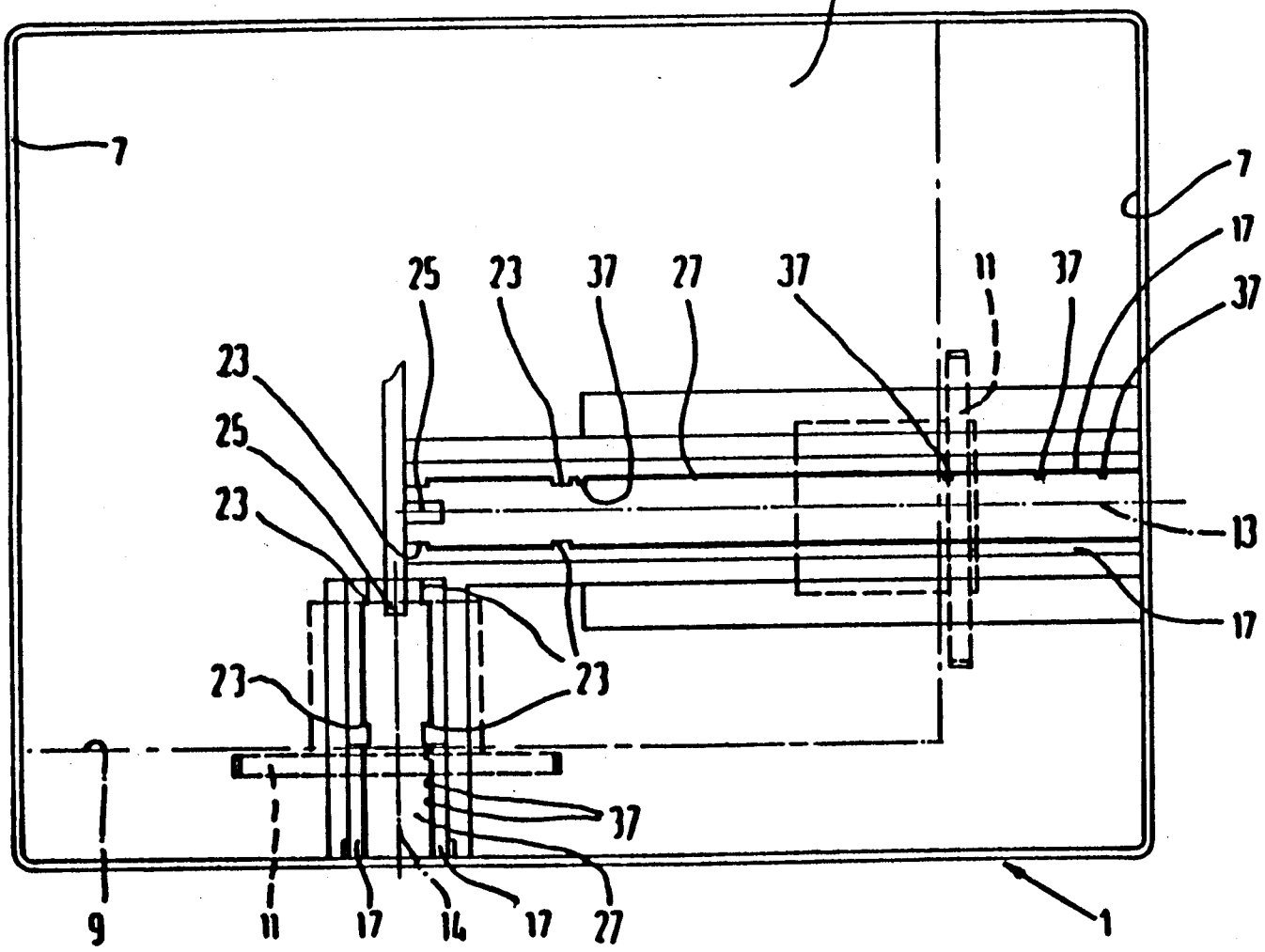
FIG. 1 is a plan view of an embodiment of the supply magazine.

Referring now to the accompanying drawings, the embodiment of a supply container for stacked sheets which is illustrated in the drawing takes the form of a magazine 1 which is shown without its lid. The latter may be designed in the manner usual for such magazines, for instance as a hood-like cover made from transparent plastic material. The inner bottom surface of magazing 1 forms a sheet-support surface 3 (FIGS. 4 and 5) for a sheet stack 5 which can be accommodated in the magazine 1 and, as can be inferred from FIGS. 1 and 3, rests with one longitudinal side and one transverse side against the inner side of the adjacent side wall 7 of magazine 1. At the other edges not resting against side wall 7, the contour of sheet stack 5 is made visible in FIGS. 1 to 3 by a dash-dotted line 9.

Figure 2:
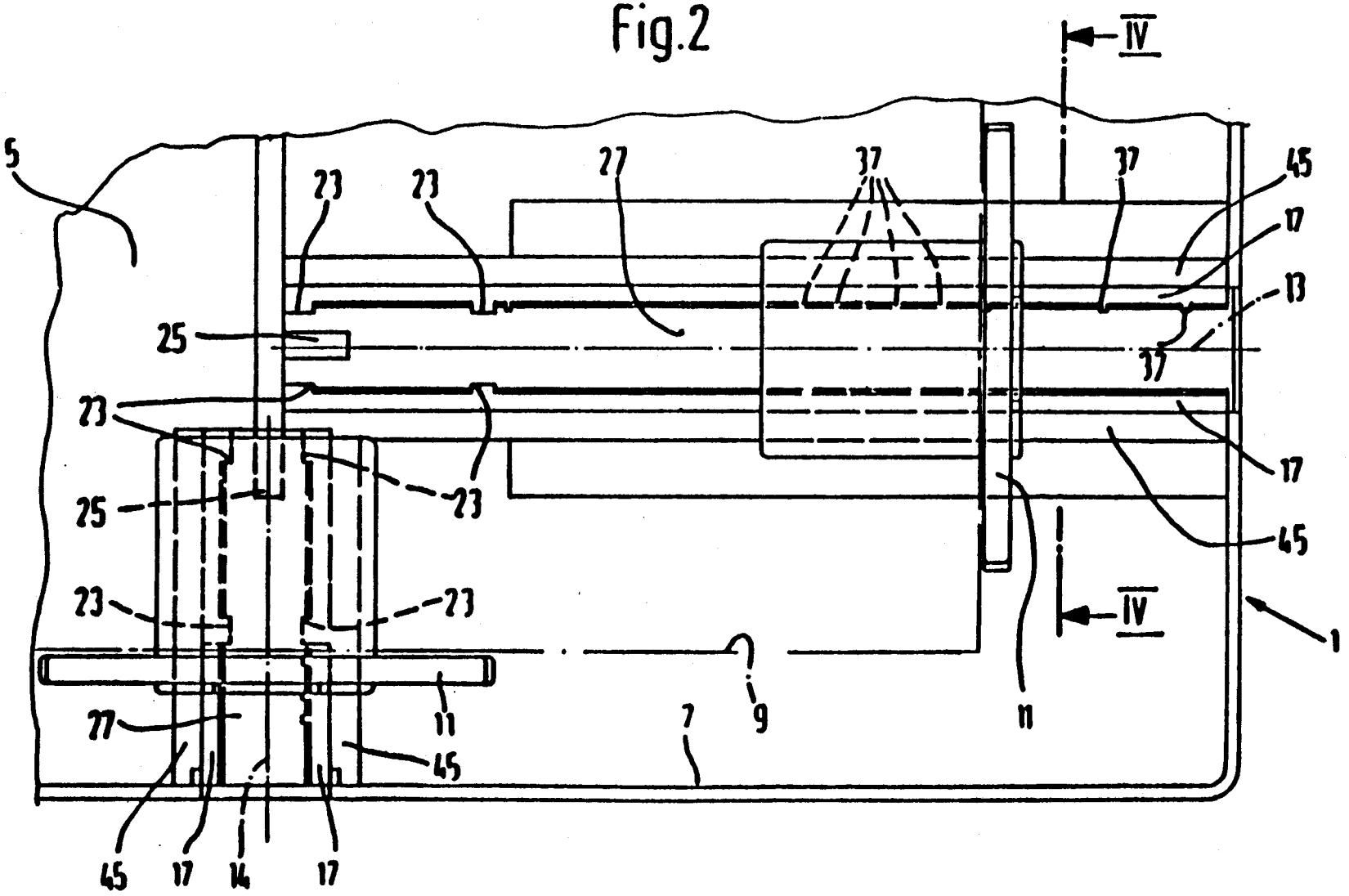
FIG. 2 is a partial plan view of the embodiment illustrated on a larger scale than in FIG. 1 and comprising size-limiting elements which are lockable against sliding by positive engagement.
Figure 4:
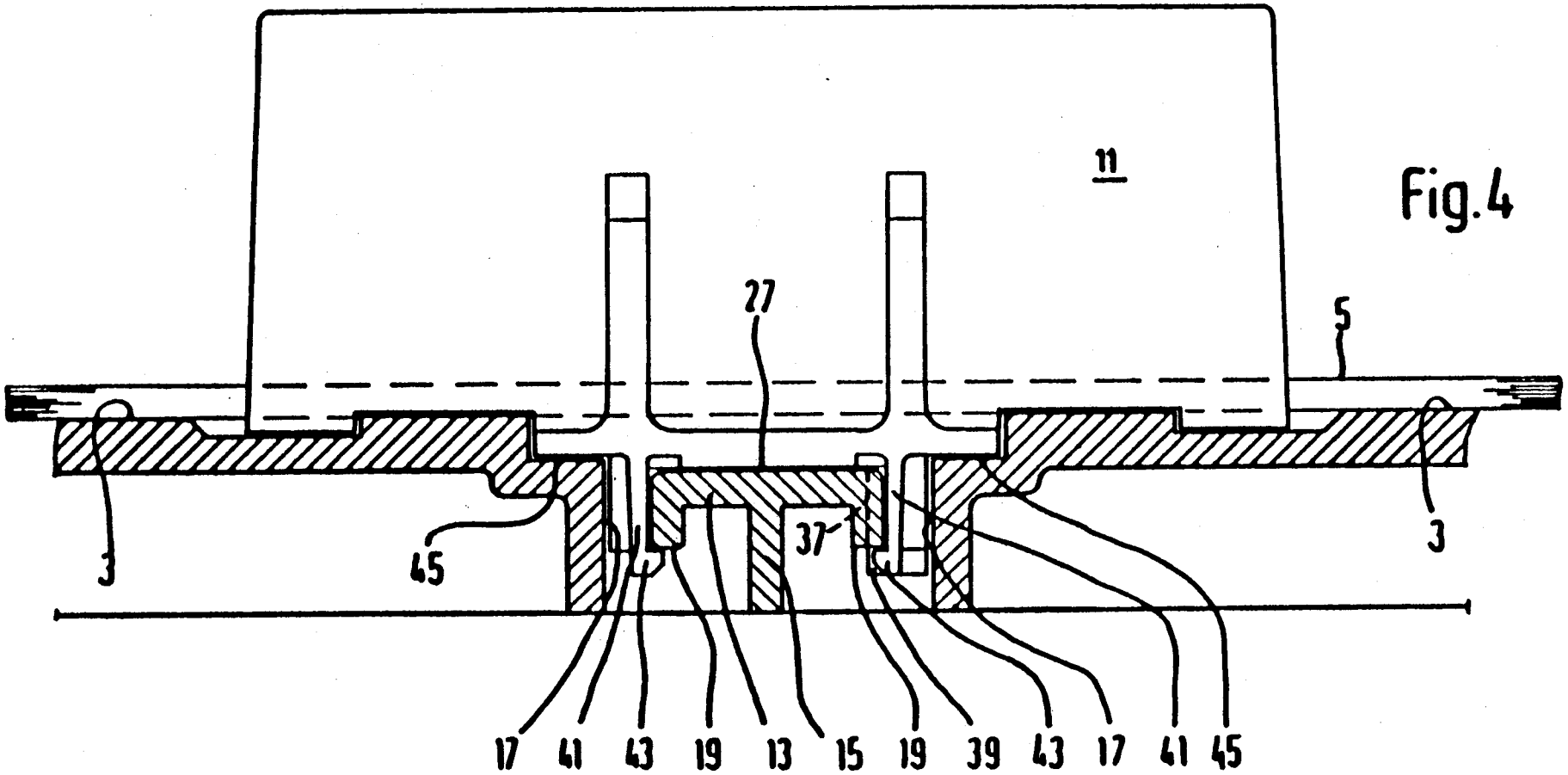
FIGS. 4 and 5 are sectional views on a still larger scale than FIGS. 2 and 3, with parts broken away and taken along the lines IV—IV and V—V of FIG. 2 and FIG. 3 respectively.
Figure 5:
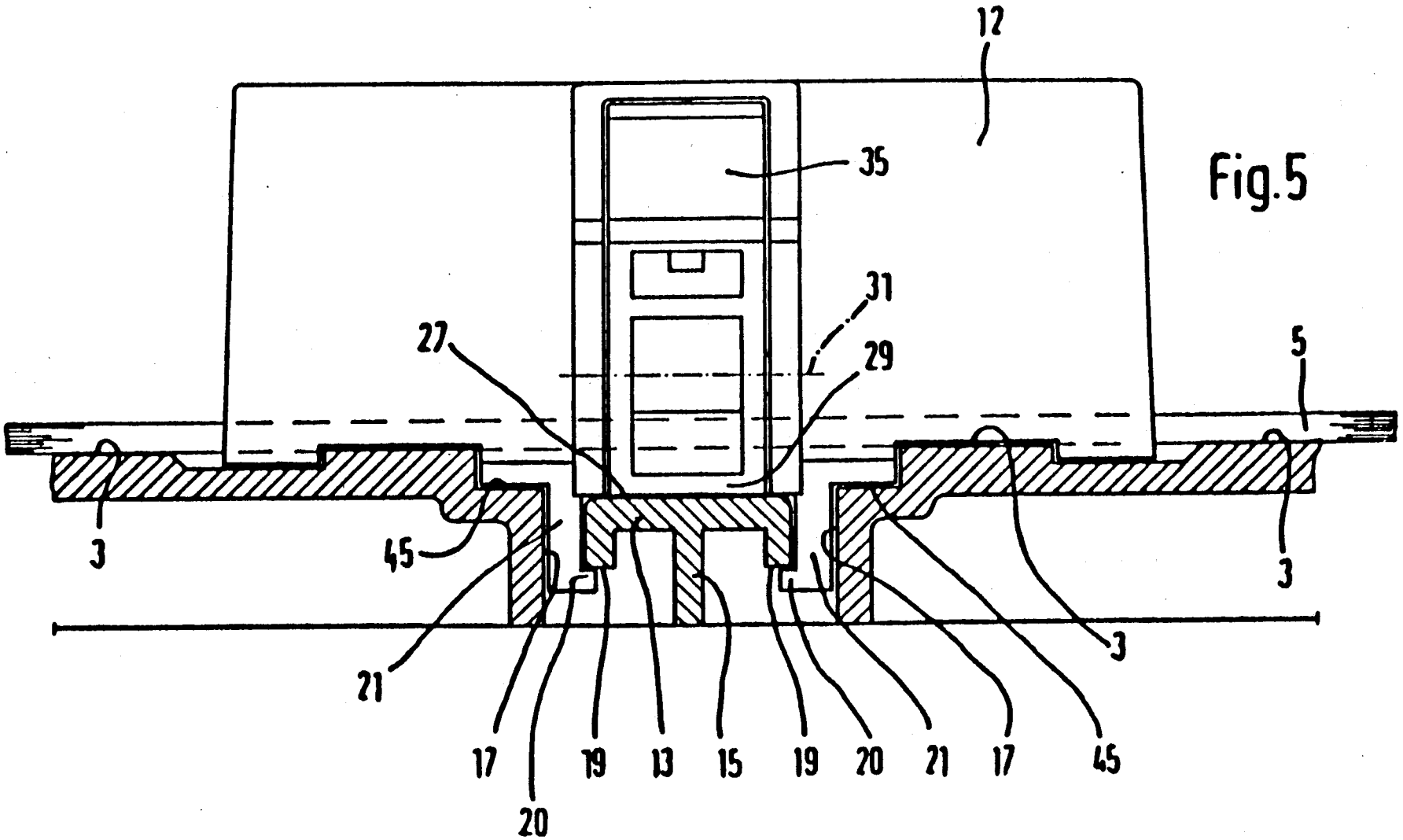

In order to position the sheet stack 5 at its free edges shown by the dash-dotted contour line 9, limiting members are provided in the interior of magazine 1. Various types of such limiting members are usable in the present magazine 1. FIGS. 1, 2 and 4, for example, show limiting members 11 which are secured by positive engagement against movement relative to the side walls 7 of magazine 1 along the support surface 3 whereas the FIGS. 3, 5 and 6 show limiting members 12 which can be secured against such movement by frictional engagement.

In order to allow the limiting members 12 to carry out a straight shifting movement along the sheet-support surface 3, guide means in the form of slideways 13 and 14 are disposed at an angle of 90° to each other on the bottom surface of magazine 1. Details of the basically identical design of the slideways 13 and 14, of which slideway 14 is just shorter than slideway 13 and provided for a relatively shorter shifting path, can best be inferred from FIGS. 4 and 5 where slideway 13 is illustrated in section. As shown by the example of slideway 13, a central T-beam 15 is provided which extends in the longitudinal guiding direction and whose inner end forms an integral unit with the bottom surface of magazine 1 whilst its outer end forms an integral unit with side wall 7 of magazine 1. If magazine 1 consists of plastic material, the slideways 13, 14 are molded as one piece together with the other parts of the magazine. The T-beam is separated from the adjacent areas of the bottom surface of magazine 1 on either side by an opening slot 17 extending in the longitudinal guiding direction. As can be seen most clearly from FIGS. 5 and 6, that part of the limiting member which is intended for cooperation with the slideway 13 is designed as a slider mounted and guided on the T-beam 15, with which it is held in positive engagement, and secured against separation. The positive guiding engagement is brought about in that guide elements 20, integrally formed with the lower ends of holding arms 21 of the limiting element 12, engage rear holding surfaces 19 positioned on the lower side of the crosspiece of T-beam 15. As can be inferred from FIGS. 5 and 6, four guide elements 20 and four holding arms 21 are provided in the present embodiment.

Figure 3:
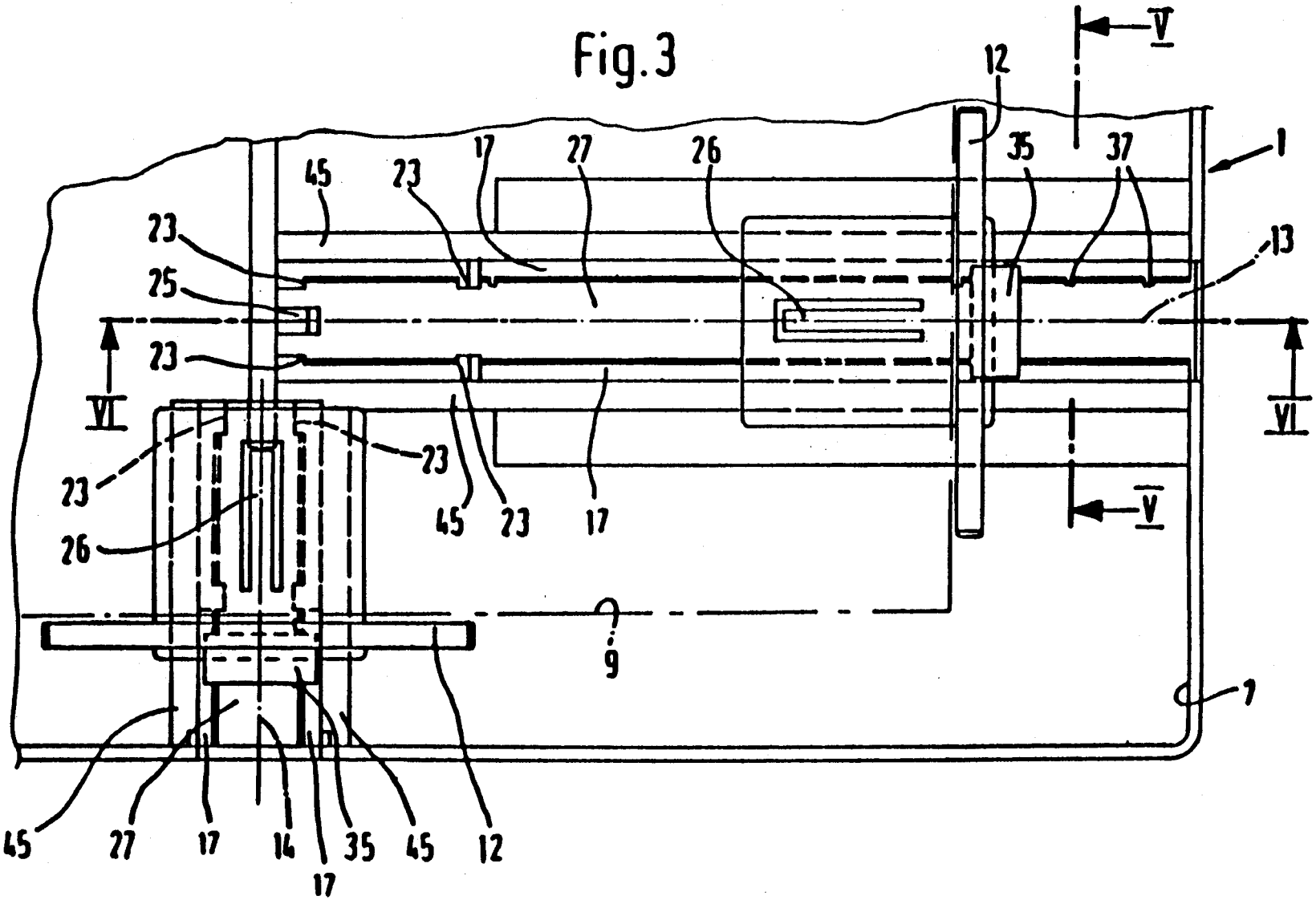
FIG. 3 is a partial plan view corresponding to FIG. 2 which, however, includes size-limiting elements which can be secured against sliding by frictional engagement.

In order to position the limiting members 12 on the associated slideway 13, 14, i.e. to bring the guide elements 20 into engagement with the holding surfaces 19 although the guide elements 20 extend inwardly beyond the inner width of the opening slots 17, the slideways 13, 14 feature recesses 23, see FIGS. 2 and 3, at points outside the range provided for the size adjustment by the limiting members 12 on either side of the crosspiece of T-beam 15. These recesses allow passage of the holding arms 21 with the guide elements 20, and thus the limiting members 12 to be placed on T-beam 15 from above. As a result of a shifting movement of limiting member 12 during which said member is slid into the normal shifting area along T-beam 15, the guide elements 20 are moved out of the area of the recesses 23 and into contact with the rear holding surfaces 19.

Figure 6:
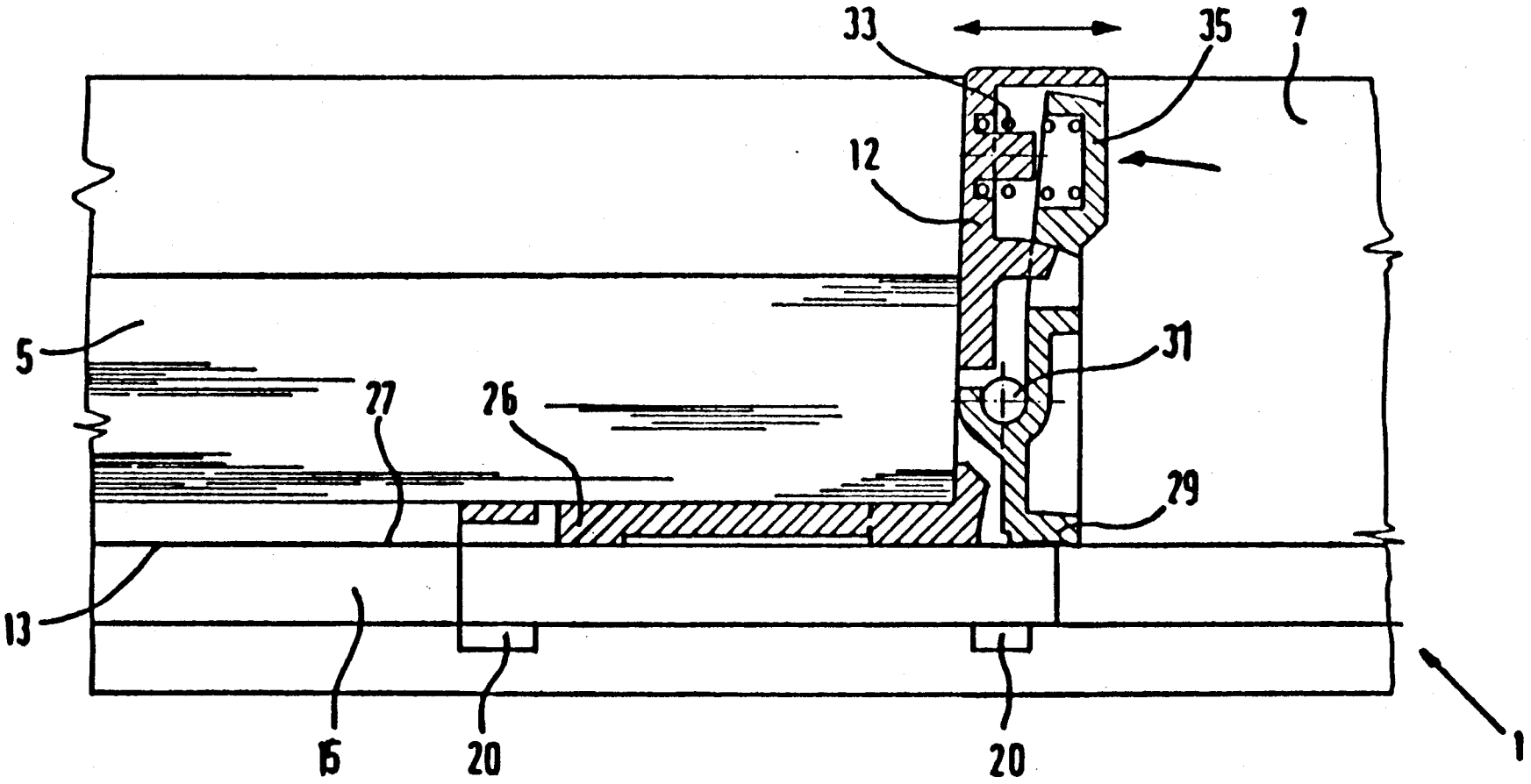
FIG. 6 is a sectional view on the same scale as FIGS. 4 and 5, with parts broken away and taken along line VI—VI in FIG. 3.

When the arms 21 with the guide elements 20 are passed through the recesses 23, a locking element 25, slightly projecting upwardly from the upper side of the crosspiece of T-beam 15, cooperates with a resilient latch 26 and slightly deflects such latch upwardly out of the position shown in FIG. 6. During shifting of limiting member 12 from its initial position in which the guide elements 20 are aligned with the recesses 23, latch 26 is disengaged from locking element 25 and spring-urged against the upper side of T-beam 15. If limiting member 12 is subsequently returned, the guide elements 20 can no longer reach a position in which they are aligned with the recesses 23 because the end of latch 26 abuts the locking element 25 before the initial alignment position has been reached.

The plane upper side of T-beam 15 which is opposite to the holding surfaces 19 forms a clamping surface 27 cooperating with a clamping means of limiting member 12 to secure the limiting member by frictional engagement against displacement along slideway 13, 14. The clamping means comprises a movable pressure member 29, see FIG. 6, which is pivotally mounted at 31 on limiting member 12 and is urged by the force of a spring 33 to carry out a pivotal movement during which it exerts pressure on the clamping surface 27 from above. Due to the clamping force of pressure member 29, frictional engagement with clamping surface 27 is effected. At the same time, the guide elements 20 are pressed against the lower holding surfaces 19 of slideway 13, 14. Spring 33 influences the inner side of a handling means 35 provided at the end of a lever arm which forms an integral unit with the pressure member 29 and, along with said member, forms a two-arm lever which, as already described, is pivotally mounted at 31.

The slideways 13, 14 have recesses 37 provided at the crosspiece of T-beam 15 at one of the two opening slots 17, i.e. at the opening slot 17 disposed at the right side in FIG. 4. The recesses 37 take the form of continuous grooves which extend from the upper clamping surface 27 to the lower holding surface 19. The inner surfaces of the recesses 37 serve as abutments which are adapted to cooperate with a counterabutment provided at the associated limiting member 11 in the form of a rib-shaped projection 39 which forms an integral unit with the associated limiting member 11 which, by engagement of projection 39 with a selected recess 37, is positively secured against shifting movement relative to slideway 13, 14. The engagement between projection 39 and recess 37 is brought about in that the limiting member 11 is plugged on the T-beam 15, with four resilient arms 41 passing through the opening slots 17 in a manner similar to that of the holding arms 21 of limiting member 12. In contrast to the comparatively broader arms 21 of the limiting members 12, the resilient arms 41 of limiting members 11 can be deflected outwardly in opening slot 17 until their ends 43 which are designed as hooks snap behind the holding surfaces 19 and form a snap lock by which the relevant limiting member 11 is secured against separation from slideway 13, 14.

When put in operation, the supply magazine is equipped, depending on its use, with limiting members 11 which are provided for a given size or with limiting members 12 which are provided for continuously adjustable sizes. If the limiting members 11 provided for a given size and fixed by positive engagement are used, they are plugged on the relevant slideway 13, 14 from above, with the projection 39 provided for positioning being aligned with a recess 37 selected according to the size desired. The limiting member 11 is pressed onto the T-beam 15 until the end 43 of the arms 41 snap in behind the holding surfaces 19.

If the limiting members 12 are used which allow the size to be continuously adjusted, such elements are placed on the slideway 13, 14 from above at the inner end thereof such that the guide elements 20 are aligned with the recesses 23 and can thus be passed through the opening slots 17. When the guide elements 20 are passed through the recesses 23, latch 26 rests with its end on the upper side of locking element 25 and is deflected outwardly. If the limiting member 12 is now shifted into the normal shifting area, latch 26 disengaged with its end from locking element 25. In this manner, a locking connection is formed which prevents the limiting member 12 from returning to a position in which the guide elements 20 would be aligned with the relevant recesses 23. Therefore, the limiting member 12 can be removed from the slideway 13, 14 only if latch 26 is lifted, and shifting beyond the normal shifting area is thus made possible. This prevents the limiting member 12 from being inadvertently disengaged from slideway 13, 14 if it is involuntarily shifted beyond the normal shifting area.

Due to the fact that spring 33 of the clamping means of limiting member 12 normally urges pressure member 29 into the clamping position, the limiting member 12 is automatically secured by frictional engagement against shifting movement as soon as handling means 35 of pressure member 29 is released by the operator.

Surface area 45 of the bottom surface of magazine 1, see FIGS. 4 and 5, which are adjacent to the opening slot 17 and extend across the whole length of the slideway 13, 14 serve as adjacent guide surfaces which ensure contact, over a larger area, with adjacent countersurfaces of the limiting members 11 or 12. Due to this contact over a large area, the limiting members 11, 12 are secured against tilting The above description and the drawings are confined to features as are essential for describing examples of the invention. Inasmuch as features disclosed in the description and in the drawings are not mentioned in the claims, they also serve if necessary to define the subject matter of the invention.

We claim:

1. Supply magazine for stacked sheets, said magazine including an inner bottom surface forming a sheet-support surface, at least one slideway provided on said bottom surface and serving to guide a limiting member which is shiftable along said slideway in order to continuously adjust the size of said sheet-support surface, and a clamping surface provided on said slideway to cooperate with a clamping means arranged on said limiting member in order to secure said limiting member by frictional contact in selected positions against shifting along said slideway, characterized in that abutments are recesses (37) arranged on said slideway (13, 14), said recess abutments being distributed along said slideway (13, 14) in positions corresponding to the sizes of selected sheet formats, and said recess abutments are provided for engagement of a complementary counterabutment projection of said limiting member (11) insertable from the upper side of said bottom surface into said recess (37) in order to secure said limiting member by positive engagement against movement along said slideway (13, 14); said slideway (13, 14) being formed along an opening slot (17) defined in said bottom surface extending in the direction of longitudinal guidance; said slideway (13, 14) comprising a holding surface (19) adapted for positive guiding engagement with said limiting member (12); an upper opening edge surface contiguous with said opening slot (17) and adjacent to said slideway (13, 14) and a lower opening edge surface contiguous with said opening slot (17) and facing away from clamping surface (27) forming said holding surface (19) of said slideway (13, 14) which is provided for size limitation, and engageable by a guide element (20) of said corresponding limiting member (12); at a point outside the shifting area, said holding surface (19) comprising at least one recess (23) of a size allowing said guide element (20) and said holding surface (19) to become disengaged; and said clamping surface (27) of said slideway (13, 14) and holding surface (19) thereof facing opposite sides so that said guide element (20) of said limiting member (12) can be pressed onto said holding surface (19) of said slideway (13, 14) by the clamping force exerted on said clamping surface (27) by a pressure member (29).

2. Supply magazine according to claim 1, characterized in that a locking mechanism (25, 26) is operative between said slideway (13, 14) and said limiting member (12) arrestable by friction, said locking mechanism preventing said limiting member (12) from being shifted beyond the shifting area provided for size limitation.

3. Supply magazine according to claim 2, characterized in that said locking mechanism comprises a latch (26) which is spring-loaded to move into a locking position and arranged on said limiting member (12), and a locking element (25) which is arranged on said slideway (13, 14) and adapted to cooperate with said latch (26).

4. Supply magazine according to claim 1, characterized in that said limiting member (11) which can be arrested against shifting by positive engagement with recesses (37) of said slideway (13, 14) can be fixed against separation from said bottom surface by means of a plug connection effective between said slideway (13, 14) and said limiting member (11), said fixing means including a snap lock.

5. Supply magazine according to claim 4, characterized in that said means for forming the plug connection comprises at least one holding element (43) resiliently mounted on said limiting member (11) in order to enable said limiting member to snap in behind said holding surface (19) of said slideway (13, 14) when placed thereon.

6. Supply magazine according to claim 1, characterized in that two parallel opening slots (17) are defined whose neighboring opening edge surfaces are in turn defined by wall portions of a T-beam (15) extending in the longitudinal guiding direction between said two opening slots (17).

7. Supply magazine according to claim 6, characterized in that said clamping surface (27) is defined by the upper side of the crosspiece of said T-beam (15) which extends parallel with the plane of said sheet-support surface (3) and in that the lower sides of both ends of said crosspiece each form a partial surface of said holding surface (19) of said slideway (13, 14).

8. Supply magazine according to claim 6, characterized in that the guide element (20) of said limiting member (12) which is arrestable by friction is arranged on an arm (21) extending through said opening slot (17), and in that said recess (23) which is located outside the shifting area of said slideway (13, 14) is formed by a broadened portion of said opening slot (17).

9. Supply magazine according to claim 7, characterized in that on said limiting member (12) which is arrestable by frictional engagement, at least two arms (21) with one guide element (20) each are provided which are adapted to pass through each of said two opening slots (17) and at least one recess (23) is provided on each of said opening slots (17).

10. Supply magazine according to claim 1, characterized in that said limiting member (11) which is arrestable by positive engagement comprises at least one resilient arm (41) which can be passed through said opening slot (17) and is adapted by means of its end (43) forming said holding element to snap in behind said holding surface (19).

11. Supply magazine according to claim 1, characterized in that surface areas (45) of said bottom surface, which are positioned adjacent said opening slot (17), serve as guide surfaces for cooperating with complementary countersurfaces of said limiting member (11 or 12) which is arrestable by frictional engagement and/or by positive engagement.

* * * * *